US010619490B2

(12) United States Patent
Friedrich et al.

(10) Patent No.: US 10,619,490 B2
(45) Date of Patent: Apr. 14, 2020

(54) TURBINE ROTOR BLADE ARRANGEMENT FOR A GAS TURBINE AND METHOD FOR THE PROVISION OF SEALING AIR IN A TURBINE ROTOR BLADE ARRANGEMENT

(71) Applicant: Rolls-Royce Deutschland Ltd & Co KG, Blankenfelde-Mahlow (DE)

(72) Inventors: Michael Friedrich, Schwielowsee (DE); Sebastian Schrewe, Berlin (DE)

(73) Assignee: ROLLS-ROYCE DEUTSCHLAND LTD & CO KG, Blankenfelde-Mahlow (DE)

( * ) Notice: Subject to any disclaimer, the term of this patent is extended or adjusted under 35 U.S.C. 154(b) by 165 days.

(21) Appl. No.: 15/845,131

(22) Filed: Dec. 18, 2017

(65) Prior Publication Data

US 2018/0171804 A1 Jun. 21, 2018

(30) Foreign Application Priority Data

Dec. 19, 2016 (DE) ..... 10 2016 124 806

(51) Int. Cl.
*F01D 5/18* (2006.01)
*F01D 5/08* (2006.01)
(Continued)

(52) U.S. Cl.
CPC ..... *F01D 5/187* (2013.01); *F01D 5/087* (2013.01); *F01D 5/18* (2013.01); *F01D 11/006* (2013.01);
(Continued)

(58) Field of Classification Search
CPC ..... F01D 5/187; F01D 5/087; F01D 5/082; F01D 5/081; F01D 5/18; F01D 11/006; F01D 11/04
(Continued)

(56) References Cited

U.S. PATENT DOCUMENTS 4,425,079 A * 1/1984 Speak ..... F01D 5/081 415/115
4,505,640 A 3/1985 Hsing et al.
(Continued)

FOREIGN PATENT DOCUMENTS

EP 1004748 A2 5/2000
EP 1041246 A1 10/2000
(Continued)

OTHER PUBLICATIONS

German Search Report dated Oct. 26, 2017 for counterpart German Application No. DE 10 2016 124 806.1.
(Continued)

*Primary Examiner* — Nathaniel E Wiehe
*Assistant Examiner* — Latoia L Sudler
(74) *Attorney, Agent, or Firm* — Shuttleworth & Ingersoll, PLC; Timothy J. Klima

(57) ABSTRACT

A turbine rotor blade arrangement for a gas turbine, having a turbine disc and a turbine rotor blade ring that comprises a plurality of rotor blades. The turbine disc has disc channels for providing air, wherein a disc channel respectively ends in a discharge hole in the area of a blade root reception area. The rotor blades have cooling air channels for cooling the rotor blades. In the blade root or between the blade root and the blade root reception area, an air channel is formed via which sealing air is discharged that is fed in from the disc channel. It is provided that the blade root comprises a deflection device that is provided and is configured for the purpose of partially deflecting air exiting the disc channel in the direction of the air channel. Another embodiment of the invention relates to a method for the provision of sealing air in a turbine rotor blade arrangement.

20 Claims, 10 Drawing Sheets

(51) Int. Cl.
*F01D 11/00* (2006.01)
*F01D 11/04* (2006.01)
*F01D 5/30* (2006.01)

(52) U.S. Cl.
CPC ..... *F01D 11/04* (2013.01); *F01D 5/3007* (2013.01); *F01D 11/001* (2013.01); *F05D 2220/32* (2013.01); *F05D 2240/301* (2013.01); *F05D 2240/55* (2013.01); *F05D 2240/81* (2013.01); *F05D 2260/201* (2013.01)

(58) Field of Classification Search
USPC ..... 415/173.7
See application file for complete search history.

(56) References Cited

U.S. PATENT DOCUMENTS 4,820,116 A * 4/1989 Hovan ..... F01D 1/32 415/115
4,820,123 A 4/1989 Hall
5,984,636 A * 11/1999 Fahndrich ..... F01D 5/3015 415/178
6,022,190 A * 2/2000 Schillinger ..... F01D 5/081 415/115
6,077,035 A * 6/2000 Walters ..... F01D 5/081 415/115
6,290,464 B1 9/2001 Negulescu et al.
6,565,318 B1 5/2003 Tiemann
6,575,704 B1 6/2003 Tiemann
7,192,245 B2 * 3/2007 Djeridane ..... F01D 5/082 415/115
7,503,748 B2 * 3/2009 Ferra ..... F01D 5/082 415/115
7,520,718 B2 * 4/2009 Engle ..... F01D 5/3015 415/173.7
8,100,633 B2 * 1/2012 Propheter-Hinckley ..... F02C 7/18 415/115
8,152,436 B2 * 4/2012 Glasspoole ..... F01D 5/3007 415/1
8,348,615 B2 * 1/2013 Bluck ..... F01D 5/081 415/115
8,408,866 B2 * 4/2013 Weaver ..... F01D 5/082 415/115
8,807,942 B2 * 8/2014 Tibbott ..... F01D 5/081 416/193 A
2012/0003103 A1 1/2012 Tholath
2015/0086361 A1 3/2015 Ahmad et al.
2019/0120057 A1 * 4/2019 Lee ..... F01D 5/087

FOREIGN PATENT DOCUMENTS

EP 1183444 A1 3/2002
EP 2236746 A1 10/2010
WO WO0075491 A1 12/2000

OTHER PUBLICATIONS

European Search Report dated May 2, 2018 for counterpart European Patent Application No. 17208073.1.

* cited by examiner

TURBINE ROTOR BLADE ARRANGEMENT FOR A GAS TURBINE AND METHOD FOR THE PROVISION OF SEALING AIR IN A TURBINE ROTOR BLADE ARRANGEMENT

REFERENCE TO RELATED APPLICATION

This application claims priority to German Patent Application No. 10 2016 124 806.1 filed on Dec. 19, 2016, the entirety of which is incorporated by reference herein.

BACKGROUND

The invention relates to a turbine rotor blade arrangement and a method for the provision of sealing air in a turbine rotor blade arrangement.

It is known to cool the turbine rotor blades of a gas turbine. For cooling the turbine rotor blades, the turbine rotor blades have internal cooling air channels that are impinged with air that is supplied via a disc channel in the turbine disc. At that, the disc channels end at the blade root reception areas of the turbine disc that receive the blade roots of the turbine rotor blades. Here, a portion of air that exits from a disc channel is discharged as leakage flow through a gap formed between the blade root and the blade root reception area and extending in the axial direction. The air that escapes through the gap as a leakage flow is referred to as sealing air, since a driving pressure ratio is present across the gap, and the air can be used for sealing. The air that exits from a disc channel is thus referred to as cooling air if it serves for cooling purposes, and is referred to as sealing air if it exits as a leakage flow, wherein sealing air can generally also be used for cooling different components.

In the event of unfavorable operational conditions or structural component tolerances, there is the danger of the driving pressure ratio being reduced across the gap between the blade root and the blade root reception area and leading to a reversal of the leakage flow. Since this leakage flow also represents a part of the sealing air sealing against the hot air from the main flow channel of the gas turbine, which has very high temperatures directly behind the combustion chamber, there is the danger of such hot air flowing in front of the turbine disc, and further entering the turbine rotor blade via the mentioned gap and damaging the disc.

U.S. Pat. No. 4,505,640 A describes is a turbine rotor blade arrangement in which the gap that is formed between the blade root and the blade root reception area is sealed by means of a seal to minimize the leakage flow.

There is a need to provide a turbine rotor blade arrangement and a method for providing sealing air which reliably protect air channels formed in the blade root or between the blade root and the blade root reception area against hot air.

SUMMARY

According to an aspect of the invention, a turbine rotor blade arrangement is provided that comprises a turbine disc and a turbine rotor blade ring. The turbine disc is rotatable about a machine axis of the gas turbine and has a plurality of blade root reception areas at its circumference. The turbine rotor blade ring comprises a plurality of rotor blades that respectively comprise one blade root and that are attached at the circumference of the turbine disc by means of the blade roots being arranged in the blade root reception areas. The turbine disc comprises disc channels that serve for providing air and extend with a radial directional component. A disc channel respectively ends in a discharge hole in the area of a blade root reception area. The rotor blades have cooling air channels for cooling the rotor blades. The disc channels of the turbine disc and the cooling air channels of the rotor blades are embodied and arranged in such a manner that during operation air is supplied via the disc channels of the turbine disc to the cooling air channels of the rotor blades. Here, the air that is exiting from a disc channel has a radial directional component.

In the blade root or between the blade root and the blade root reception area, the rotor blades of the regarded turbine rotor blade arrangement further comprise respectively at least one air channel via which sealing air supplied from the disc channel is discharged. Sealing air that is discharged from the disc channel is conducted further from the blade root via the air channel.

It is provided that the blade root has a deflection device which is provided and arranged to deflect air that is discharged from the disc channel partially in the direction of the air channel. Through the targeted deflection of air exiting from the disc channel by means of the deflection device that is provided for that purpose, a part of the dynamic pressure share of the air exiting from the disc channel is maintained and the driving pressure ratio across the air channel is thus increased.

Such aspect of the present invention is based on the insight that the dynamic pressure of the air flow is maintained by providing a deflection device that is arranged in the or at the blade root, which leads to an increase in the total pressure. Such a pressure increase has several advantages. A first advantage is the fact that, due to the increased pressure, the danger of hot gas flowing from the main flow channel through the air channel in the rotor blade or a flow reversal taking place in the air channel in the event of unfavorable operational states is eliminated. The danger of a damage to the rotor blades through hot gas is thus excluded.

A further advantage is the fact that the sealing air that flows across the air channel with an increased total pressure ratio can be used for reliably fulfilling different functions in the gas turbine. Such a function may for example consist in using air flowing out of the air channel for sealing. In particular it can be provided that the air is applied to seals that are configured in the edge area of the main flow channel of the gas turbine between the rotating turbine rotor blade arrangement and the adjoining non-rotating structures, in particular an adjoining turbine guide vane ring (so-called "rim seals" or wheel side space seals). A further function that can be realized by means of the increased total pressure is the targeted use of this air for realizing or supporting a so-called microturbine. The concept of a microturbine is described in EP 1 004 748 B1, which is therefore referred to.

A further advantage associated with aspects of the invention is the fact that the diameter of the disc channels that are formed in the turbine disc can be reduced due to the increase in the total pressure in the air channel that is provided by the deflection device. For, thanks to the invention, a sufficient pressure build-up can also be provided in comparatively small disc channels. Without the present invention, the pressure loss (expansion loss) through the reduction of the diameter would rise during the transition into the hollow space inside the blade root. This can be compensated through the invention, which allows for a reduction in the disc channel diameter, whereby tension peaks are reduced, and thus the stability of the turbine disc is increased.

The air channel, into which cooling air is deflected by means of the deflection device, can for example be a gap that extends in the axial direction between the blade root reception area and the blade root arranged therein. Here, the deflection device can be arranged at the bottom side of the blade root. Air that is discharged from the discharge hole of the disc channel is thus deflected by means of the deflection device at the bottom side of the blade root and transported with sufficient dynamic pressure in the air channel that is formed by the gap between the blade root and the blade reception area.

However, it is to be understood that the air channel can also be formed in a different manner than by the gap between the blade root and the blade reception area. For example, it can be provided that the blade root forms a hollow space into which at least a portion of the air flows before being conducted as cooling air into the cooling air channels of the rotor blade. Here, it can be provided that one or multiple air channels extend in the blade root from such a blade root hollow space to an opening that is formed at the leading edge or at the trailing edge of the blade root. Here, the orientation of the flow in the air channel can be adjusted based on the radial distance of the opening from the bottom side of the blade root and its orientation.

According to one embodiment of the invention, it is provided that the deflection device partially covers the discharge hole of the disc channel. Here, the term coverage refers to a view from above (counter to the radial direction) onto the discharge hole. Through a partial coverage of the discharge hole, a targeted deflection of the air that is exiting from the disc channel can be realized in a particularly effective manner. In particular, it can be provided that the deflection device partially covers the discharge hole in a view from the top onto the same along exactly one boundary line.

However, for the targeted deflection of the air that is exiting from the disc channel as it is provided according to aspects of the invention, it is not necessary that the deflection device partially covers the discharge hole of the disc channel. The only thing that is necessary for the provided deflection of the air is that the deflection device is hit by the air that exits from the disc channel. Apart from the case of coverage, this is also the case if the air flow exiting from the disc channel is divergent, and partially flows against the deflection device as a result of being widened. At that, the air flow exiting from the disc channel becomes wider as its distance from the discharge hole increases.

In one embodiment of the invention, it is provided that the deflection device is arranged and configured in such a manner that air from the disc channel is deflected into the air channel in the direction of the leading edge of the blade root. The deflection is thus realized upstream with respect to the flow direction inside the main flow channel. Alternatively, it can be provided that sealing air is deflected into the air channel in the direction of the trailing edge of the blade root, i.e. downstream with respect to the flow direction inside the main flow channel of the gas turbine. In the latter case, sealing air is for example used for cooling or sealing components that are arranged behind the turbine rotor blade arrangement in the axial direction. In principle, it can also be provided that the rotor blade has multiple deflection devices that deflect the sealing air in different air channels, and for example cause a deflection in the direction of the leading edge, for one thing, and in the direction of the trailing edge of the blade root, for another.

In another embodiment of the invention, it is provided that the deflection device forms the initial area of the respective air channel. Here, it forms the radially outer boundary of the air channel and transitions smoothly into the air channel. Alternatively, the air channel begins only at a distance to the deflection device, in which case the deflection device guides air in the direction of the air channel, without already being a component of the air channel.

In principle, the deflection device can have a plurality of geometrical shapes and structural embodiments. For example, the deflection device can form a flat surface at which air is deflected. In the simplest case, the deflection device is a flat metal sheet that partially covers the discharge hole of the disc channel, and in this manner conducts air discharged from the disc channel into the air channel, and in doing so increases the total pressure ratio across the passage. However, in this most simple embodiment, the dynamic pressure loss occurring at the even surface is relatively high, whereby a comparatively small effect is achieved.

In an alternative embodiment, it is provided that, at least in the area that is hit by the air exiting from the disc channel, the deflection device forms a concave surface that extends concavely to the disc channel or to the air flow that is discharged from the same. Here, it can be provided that the concave surface transitions smoothly into the air channel. The configuration of the deflection device with a surface that is formed in a concave manner towards the disc channel makes it possible for the air flow exiting from the disc channel to be deflected into the air channel in a low-loss manner, while avoiding rebounding bodies that are arranged perpendicular to the flow direction. In this manner, a large portion of the dynamic pressure can be recovered, and thus the driving pressure ratio across the air channel can be considerably increased. According to one embodiment variant, if the deflection device partially covers the discharge hole of the disc channel, the deflection device, at least in the area that partially covers the discharge hole of the disc channel, forms a concave surface that extends concavely to the disc channel or to the air flow that is discharged therefrom.

According to an exemplary embodiment of the invention, in order to keep the occurring dynamic pressure losses low during the deflection of sealing air, a deflection device and an air channel can be provided in which the width and radiuses of curvature are realized in such a manner that the relationship $r_m/w>1$ is fulfilled, wherein w is the medium width of the air channel in the area of the deflection device, and $r_m$ is the mean value of a first outer radius of curvature $r_o$ and a second inner radius of curvature $r_i$, wherein the first radius of curvature $r_o$ represents the radius of curvature of the concave surface of the deflection device, and the second radius of curvature $r_i$ represents the radius in the transition from the disc channel to the leading edge of the blade root reception area.

In one embodiment of the invention, it is provided that the deflection device is formed by a nose-shaped structural component, the end of which may partially cover the discharge hole of the disc channel. Here, "nose-shaped" means that the nose-shaped structural component is not wider or only slightly wider in the circumferential direction of the turbine disc than the discharge hole of the disc channel which it partially covers.

In another embodiment, it is provided that, in a view from the top onto the discharge hole (i.e. onto a plane that is normal with respect to the radial direction), the deflection device partially covers the same along a straight boundary line. In alternative embodiments, this boundary line is formed concavely or convexly towards the discharge hole. Here, the boundary can for example be formed in a circular, elliptic, parabolic or hyperbolic manner.

According to one embodiment of the invention, the coverage of the discharge hole of the disc channel in a view from the top onto the discharge hole is at least 10% of the total cross-sectional surface of the discharge hole. The coverage can in particular be in the range of between 10% and 25%, in particular in the range of between 15% and 20%, of the total cross-sectional surface of the discharge hole. Here, the degree of coverage is to be optimized with a view to, on the one hand, providing a sufficient total pressure in the air channel and, on the other hand, not compromising the cooling air supply of the blade channels, and thus the cooling of the rotor blades.

In a further embodiment of the invention, it can be provided that the air channel is oriented at an angle to the axial direction of the gas turbine in its end section, i.e. in the section that connects to the opening of the air channel in the area of the leading edge or trailing edge of the blade root. In this manner, it is achieved that sealing air is guided at an angle into the cavity that adjoins the rotor blade. In the course of this process, work is extracted from the flow, whereby the rotor blades are additionally accelerated. Here, it can be provided that the air channels are embodied as nozzles towards their exit. Such an embodiment is also referred to as a microturbine, and is described in detail in EP 1 004 748 B1.

By providing a sufficient dynamic pressure in the air channel based on the deflection of air according to the invention, it is possible to achieve such a rotor acceleration even in cooling air passages that extend towards the leading edge of the blade root.

The deflection device can be an integral component of the blade root. It can for example be realized by a structural component that is manufactured together with the blade root as a cast part or by means of machining methods. Alternatively, the deflection device can be a separately manufactured structural component that is connected to the bottom side of the blade root after the blade root has been manufactured. In this embodiment, the deflection device can be provided as a retrofitting device for already manufactured turbine rotor blade arrangements. For example, a flat or curved metal sheet is attached at the bottom side of the blade root in such a manner that it partially covers the discharge hole of the disc channel.

According to one embodiment of the invention, it is provided that the deflection device is a constant or continuous structural component in the sense that it does not comprise holes or perforations for a through-flow of air.

The present invention also relates to a method for providing sealing air in a turbine rotor blade arrangement that comprises a turbine disc and a turbine rotor blade ring, wherein air is supplied via disc channels that are formed in the turbine disc and respectively end in a discharge hole in the area of a blade root reception area, and is blown into cooling air channels of the rotor blades of the turbine rotor blade ring. It is provided that air exiting from the disc channel is partially deflected by means of a deflection device in the direction of an air channel via which the air is conducted away from the blade root as sealing air. Here, it can be provided that the deflection device partially covers the discharge hole of the disc channel. However, that is not necessarily the case if the air exiting from the disc channel is divergent.

BRIEF DESCRIPTION OF THE DRAWINGS

The invention will be explained in more detail on the basis of exemplary embodiments with reference to the accompanying drawings in which.

DETAILED DESCRIPTION

Figure 1:
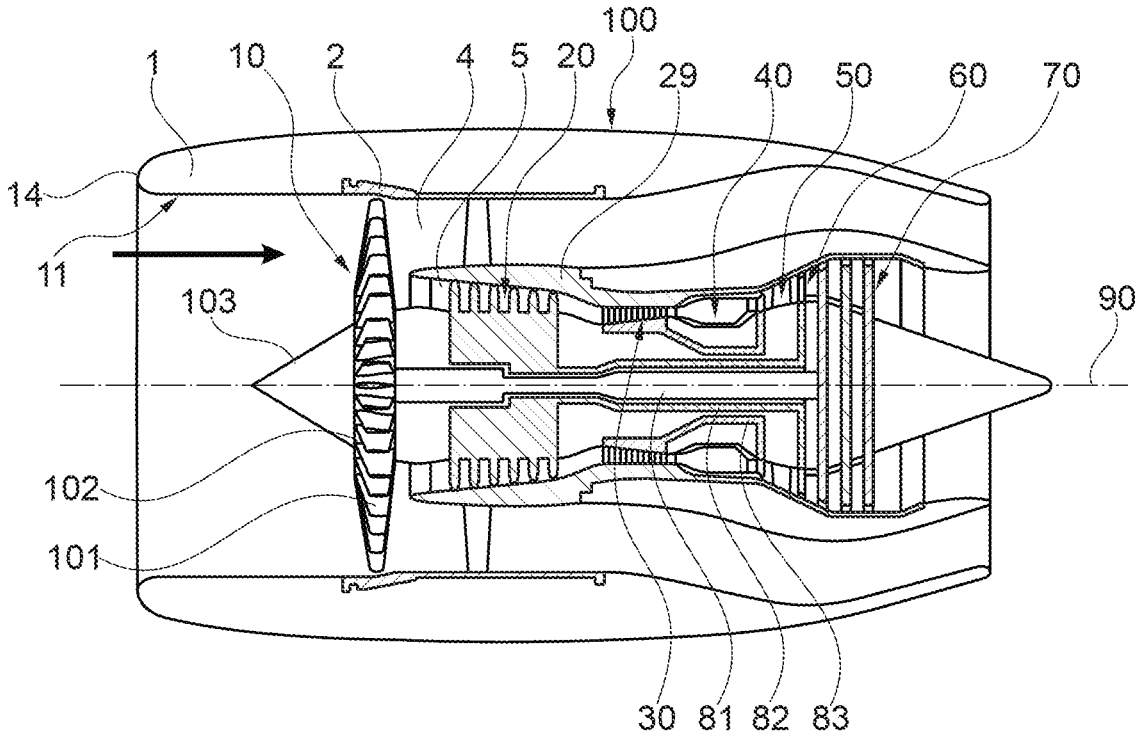
FIG. 1 shows a simplified schematic sectional view of a turbofan engine in which the present invention can be realized.

FIG. 1 shows, in a schematic manner, a turbofan engine 100 that has a fan stage with a fan 10 as the low-pressure compressor, a medium-pressure compressor 20, a high-pressure compressor 30, a combustion chamber 40, a high-pressure turbine 50, a medium-pressure turbine 60, and a low-pressure turbine 70.

The medium-pressure compressor 20 and the high-pressure compressor 30 respectively have a plurality of compressor stages that respectively comprise a rotor stage and a stator stage. The turbofan engine 100 of FIG. 1 further has three separate shafts, namely a low-pressure shaft 81 which connects the low-pressure turbine 70 to the fan 10, a medium-pressure shaft 82 which connects the medium-pressure turbine 60 to the medium-pressure compressor 20, and a high-pressure shaft 83 which connects the high-pressure turbine 50 to the high-pressure compressor 30. However, this is to be understood to be merely an example. If, for example, the turbofan engine has no medium-pressure compressor and no medium-pressure turbine, only a low-pressure shaft and a high-pressure shaft would be present.

The turbofan engine 100 has an engine nacelle 1 that comprises an inlet lip 14 and forms an engine inlet 11 at the inner side, supplying inflowing air to the fan 10. The fan 10 has a plurality of fan blades 101 that are connected to a fan disc 102. Here, the annulus of the fan disc 102 forms the radially inner boundary of the flow path through the fan 10. Radially outside, the flow path is delimited by the fan housing 2. Upstream of the fan-disc 102, a nose cone 103 is arranged.

Behind the fan 10, the turbofan engine 100 forms a secondary flow channel 4 and a primary flow channel 5. The primary flow channel 5 leads through the core engine (gas turbine) which comprises the medium-pressure compressor 20, the high-pressure compressor 30, the combustion chamber 40, the high-pressure turbine 50, the medium-pressure turbine 60, and the low-pressure turbine 70. At that, the medium-pressure compressor 20 and the high-pressure compressor 30 are surrounded by a circumferential housing 29 which forms an annulus surface at the internal side, delimitating the primary flow channel 5 radially outside. Radially inside, the primary flow channel 5 is delimitated by corresponding rim surfaces of the rotors and stators of the respective compressor stages, or by the hub or by elements of the corresponding drive shaft connected to the hub.

During operation of the turbofan engine 100, a primary flow flows through the primary flow channel 5 (also referred to as the main flow channel in the following). The secondary flow channel 4, which is also referred to as the partial-flow channel, sheath flow channel, or bypass channel, guides air that is sucked in by the fan 10 during operation of the turbofan engine 100 past the core engine.

The described components have a common rotational or machine axis 90. The rotational axis 90 defines an axial direction of the turbofan engine. A radial direction of the turbofan engine extends perpendicularly to the axial direction.

In the context of the present invention, the configuration of the rotor blade arrangement, in particular of the first stage of the high-pressure turbine 50, is of importance. However, the principles of the present invention can likewise be applied to the rotor blade arrangements of other turbine stages.

Figure 2:
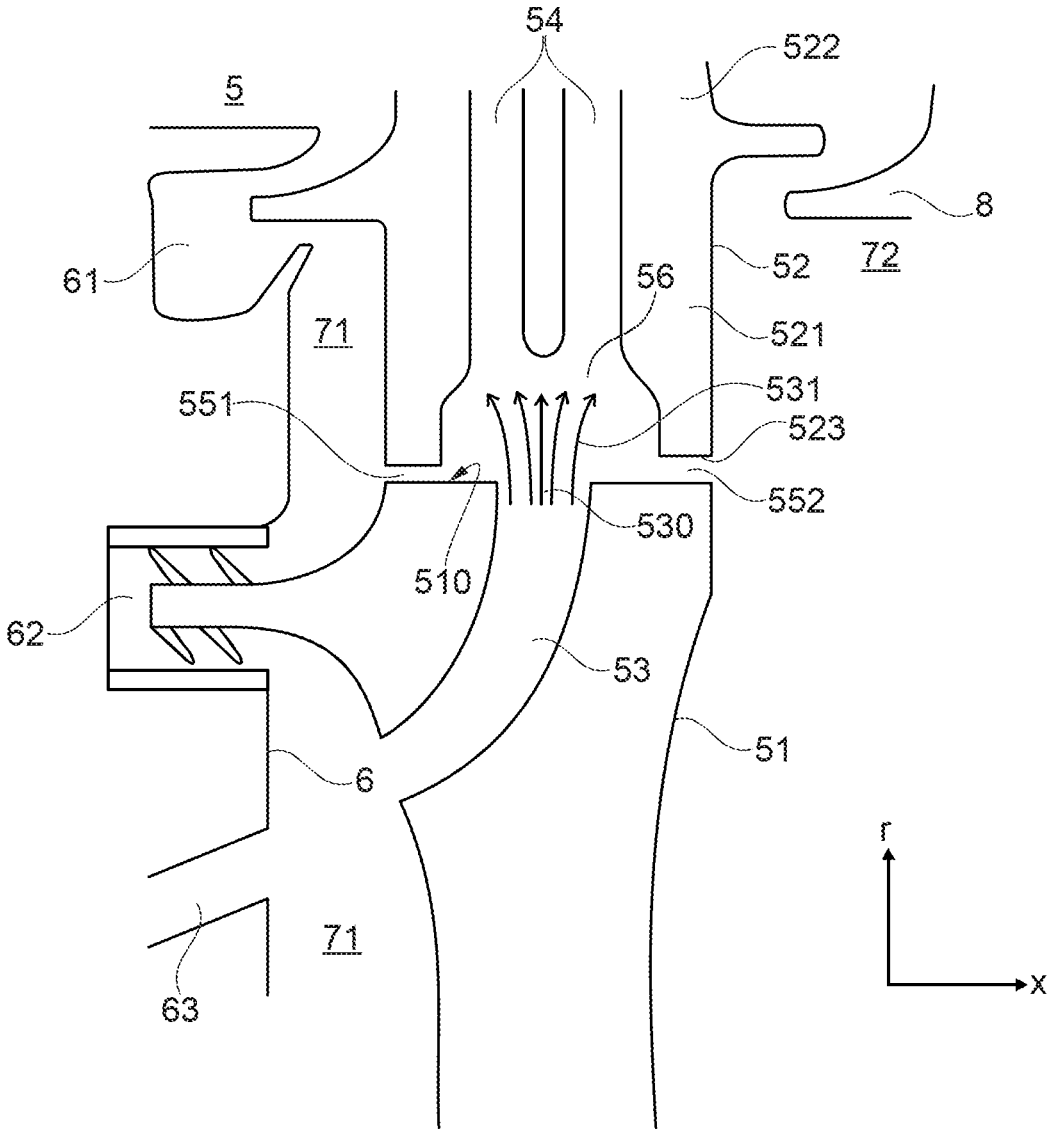
FIG. 2 shows, in a schematic manner, a turbine rotor blade arrangement according to the state of the art, comprising a turbine disc and a turbine rotor blade ring.
Figure 10:
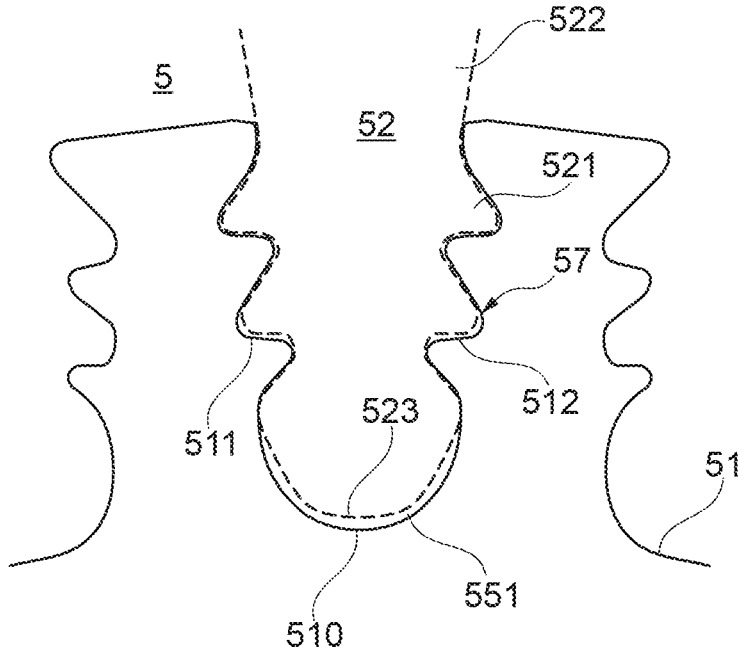
FIG. 10 shows the turbine rotor blade arrangement of FIG. 2 in a view from the front.

FIG. 2 shows, in a schematic manner and in sectional view, a turbine rotor blade arrangement as it is known from the state of the art. FIG. 10 shows such an arrangement in a view from the front. In FIG. 2, x indicates the axial direction and r indicates the radial direction. In a cylindrical coordinate system, the circumferential direction extends perpendicular to x and r. The axial direction x can be identical to the machine axis of a gas turbine in which the invention is realized, but can also differ from the same (if the rotor blades are extended at an angle to the machine axis into the blade root reception areas).

The rotor blade arrangement comprises a turbine disc 51 and a turbine rotor blade ring with rotor blades 52. The rotor blades 52 comprise respectively one blade root 521 and one blade leaf 522 that projects into a main flow channel 5 of the gas turbine. The rotor blade ring and the turbine disc 51 are set into rotation by hot gases inside the main flow channel 5 that transfer energy to the blade leafs 522, wherein the turbine disc 51 rotates about the machine axis of the gas turbine (cf. machine axis 90 of FIG. 1) and drives a drive shaft.

At its circumference, the turbine disc 51 has a plurality of blade root reception areas 57 for attaching the rotor blades 52 with equidistant distances at the circumference of the turbine disc 51, with the blade root reception areas 57 respectively serving for receiving a blade root 521 of a rotor blade 51. Here, it can for example be provided that the blade roots 521 are configured as so-called "fir-tree roots" that ensure a distribution of the absorbed centripetal forces under centrifugal force load. The blade root reception areas 57 are formed in a corresponding manner. As can in particular be seen in FIG. 10, the blade root reception areas 57 comprise a base wall 510 and two side walls 511, 512 that are arranged at a distance to each other in the circumferential direction and that are structured in such a manner that they retain the blade roots 521 in a form-fit manner.

The turbine disc 51 has disc channels 53 that serve for providing cooling air for cooling the rotor blades 52. The disc channels 53 respectively end in the area of a blade root reception area 57, namely in the base wall 510, where they form a discharge hole 530.

The rotor blades 52 comprise cooling air channels 54 that serve for cooling the rotor blades 52. The exact shape of the cooling air channels 54 and the type of cooling are not relevant for the present invention. For example, a film cooling and/or a cooling through convection may be performed. The cooling air channels 54 begin at a hollow space 56 that is formed in the blade root 521. Cooling air 531 exiting from the disc channels 53 is guided via the hollow space 56 into the cooling air channels 54.

Two gaps 551, 552 are formed between the root 521 and the blade reception area, extending respectively between the bottom side 523 of the blade root 521 and the blade root reception area. Here, one gap 551 extends from the hollow space 56 in the direction of the leading edge of the blade root 521, and the other gap 552 extends from the hollow space 56 in the direction of the trailing edge of the blade root 521. The front view of FIG. 10 shows only one gap 551 extending in the direction of the leading edge of the blade root 521.

The turbine rotor blade arrangement is arranged in the axial direction between non-rotating structures 6, 8 of the gas turbine. Thus, a static structure is located in the axial direction in front of the turbine rotor blade arrangement 6. The rotor blade arrangement and the static structure 6, for example a guide vane arrangement or a part adjoining thereto, are separated from each other by a cavity 71 that extends in the radial direction. To minimize the danger of hot gases from the main flow channel 5 entering the cavity 71, a seal 61 is provided which adjoins the main flow channel 5 (a so-called "rim seal"). If hot gases enter the cavity 71 through the seal 61, there is the danger of such hot gases damaging the turbine disc. Here, a sealing mass flow is controlled by means of a second seal 62 and the leakage or sealing air through the gap between blade root 521 and blade root reception area.

It is to be understood that, according to the rendering of FIG. 2, the cooling air is conducted into the annular space or the cavity 71 through swirl nozzles 63. Here, the cooling air changes over from the system fixed to the housing to the rotating relative system. Subsequently, the cooling air flows on into the cooling air bores 53 of the turbine disc 51. Here, the use of swirl nozzles 63 is merely optional.

In a corresponding manner, a non-rotating structure 8, for example a further guide vane arrangement, is located behind the turbine rotor blade arrangement in the axial direction, wherein the rotor blade arrangement and the structure 8 are separated from each other through a cavity 72.

Figure 3:
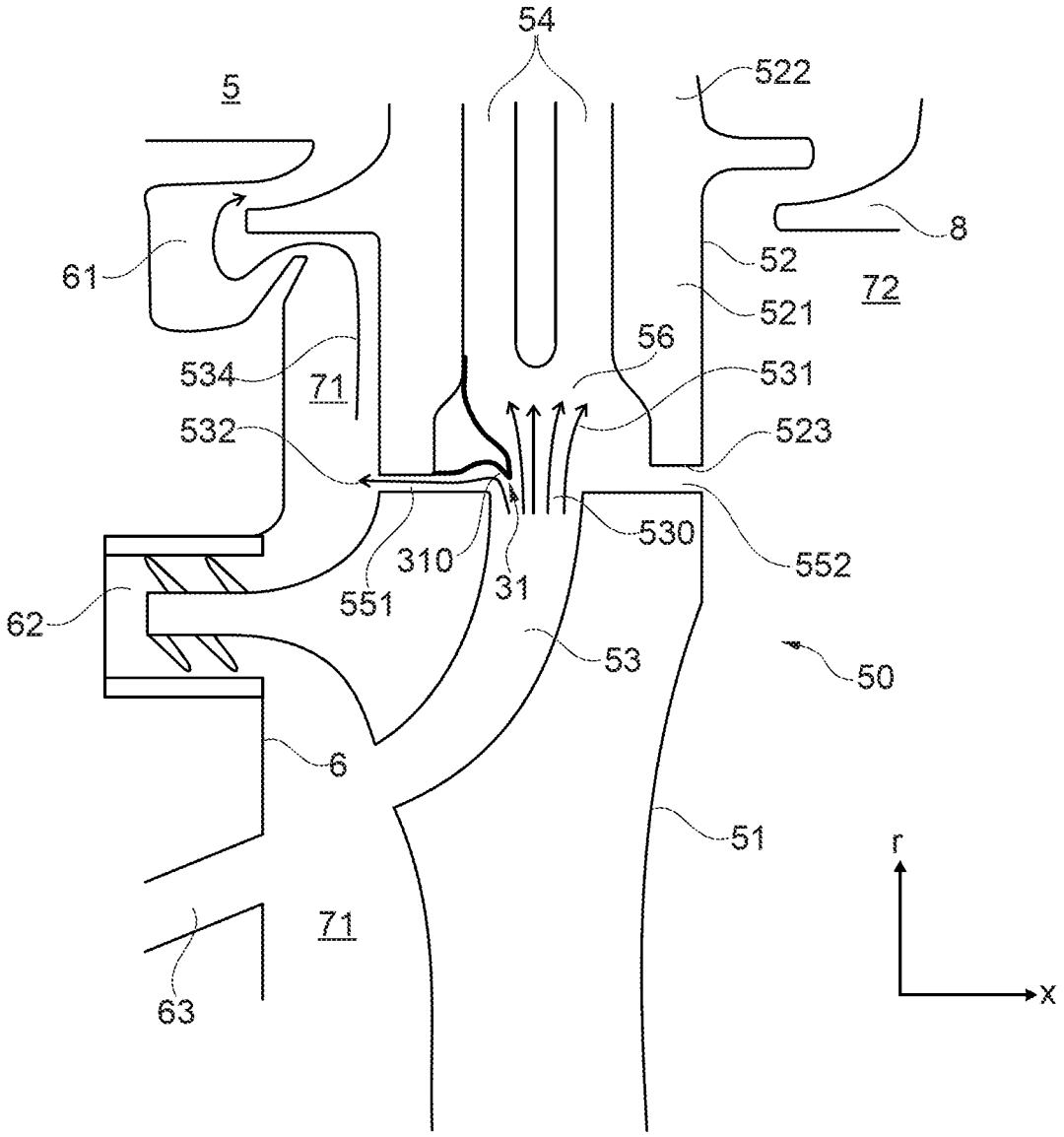
FIG. 3 shows an exemplary embodiment of a turbine rotor blade arrangement that comprises a deflection device in the form of a concavely formed structural component that deflects air into an air channel formed between the blade root and the blade root reception area.

FIG. 3 shows a first exemplary embodiment of a turbine rotor blade arrangement 50 according to the present invention. In contrast to the arrangement of FIG. 2, an additional deflection device 31 is provided, partially covering the discharge hole 530 of the disc channel 53, i.e. extending partially beyond the same. At that, the deflection device 51 is provided and configured for the purpose of partially deflecting cooling air 531 that is exiting from the discharge hole 530 in the direction of an air channel 551 so as to increase the driving pressure ratio across the same, as is indicated by the arrow 532.

In the regarded exemplary embodiment, the air channel 551 is formed by a gap that is formed between the bottom side 523 of the blade root 521 and the blade root reception area, in particular its base wall 510, and extends in the axial direction in the direction towards the leading edge of the blade root 521. However, it is to be understood that alternatively a deflection device can also be correspondingly arranged in such a manner that it deflects the cooling air in the direction of an air channel 552 that extends in the direction of the trailing edge of the blade root 521. Insofar, the shown exemplary embodiment is to be understood merely as an example.

At its bottom side 310 that is facing towards the discharge hole 530 of the disc channel 53, the deflection device 31 is formed to be concave with respect to the discharge hole 530. In this manner, it absorbs a part of the cooling air without a high pressure loss and deflects it in a low-loss manner in the direction of the air channel 551, so as to increase the driving pressure ratio. From the air channel 551, the cooling air enters the cavity 71. Due to the targeted deflection of a portion of the air by means of the deflection device 31, an increased pressure is present in the cooling air passage 551 as compared to the situation that is shown in FIG. 2. This increased pressure prevents a potential return flow via the air channel 551 and thus ensures a reliable feed to the seal 61. In this manner, the risk of hot gas entering the cavity 71 is avoided.

Thus, further functions can be realized by means of the sealing air that is provided via the air channel 551. As has been explained, it can be provided that the sealing air is used for impinging the seal 61 with sealing air according to the arrow 534 of FIG. 3, and thus to prevent hot gases from the main flow channel 5 passing the seal 61. If such a function is provided through the compressed air of the cooling air passage 551, the further seal 62 can be configured in a simplified manner.

In a further exemplary embodiment it is provided that the sealing air is blown in obliquely from the air channel 551 into the cavity 71. For this purpose, the air channel 551 is oriented obliquely with respect to the axial direction at least in that section which adjoins the cavity 71. The oblique blowing-in of the cooling air into the cavity results in an additional acceleration of the rotor blades and in a temperature drop of the cooling air. The exact relationships can be described by Euler equations.

Further, it can be provided that sealing air is provided in a corresponding manner in the air channel 552 that is extending backwards, for example to supply subsequent blade rows with compressed air, wherein this air can also be used for cooling purposes, such as e.g. blade cooling.

Figure 4:
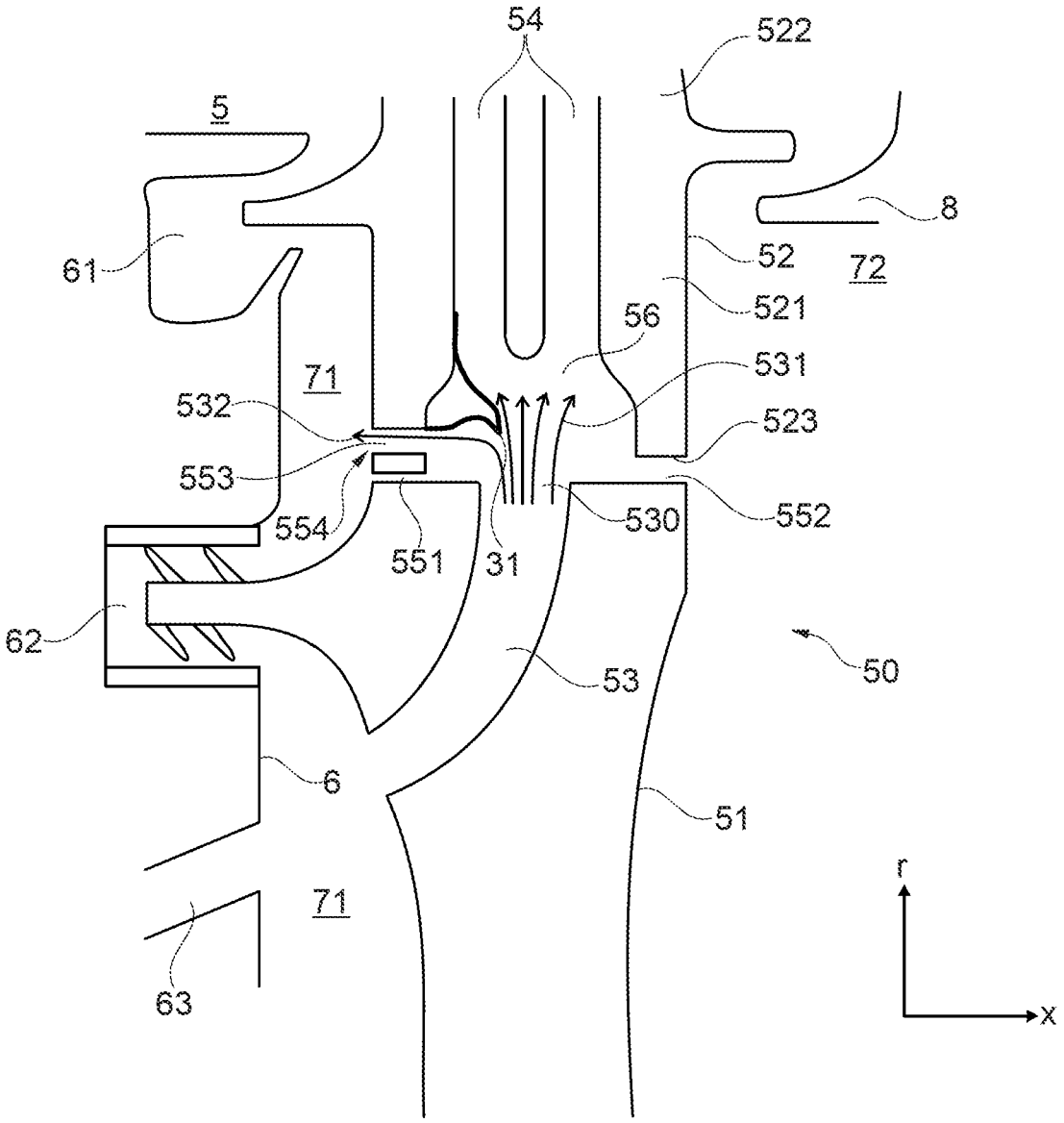
FIG. 4 shows an exemplary embodiment of a turbine rotor blade arrangement that comprises a deflection device in the form of a concavely formed structural component that deflects air into an air channel that ends at the leading edge of the blade root at a radial distance to the bottom side of the blade root.

FIG. 4 shows an exemplary embodiment of a turbine rotor blade arrangement 50 in which the air channel into which air is deflected by the deflection device 31 is not formed by the gap 551 between the blade root and blade root reception area, but rather by an additional passage. Thus, a further air channel 553 is provided. It extends at a radial distance to the bottom side 523 of the blade root 521 and ends in a discharge hole 554. In this exemplary embodiment, the deflection device 31 is arranged deeper inside the hollow space 56 of the blade root 521. An orientation of the sealing air flow exiting the air channel 553 can be realized based on the position and orientation of the discharge hole 554.

Figure 11:
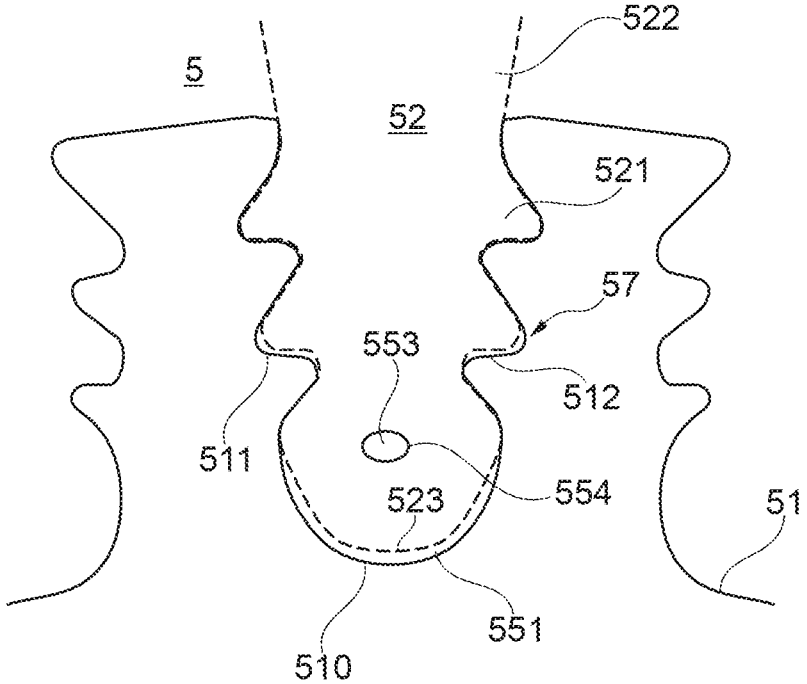
FIG. 11 shows the turbine rotor blade arrangement of FIG. 4 in a view from the front.

FIG. 11 shows the arrangement of FIG. 4 in a view from the front. The rendering mostly corresponds to the rendering of FIG. 10. In addition, the air channel 553, which ends in a discharge hole 554, is shown.

Figure 4A:
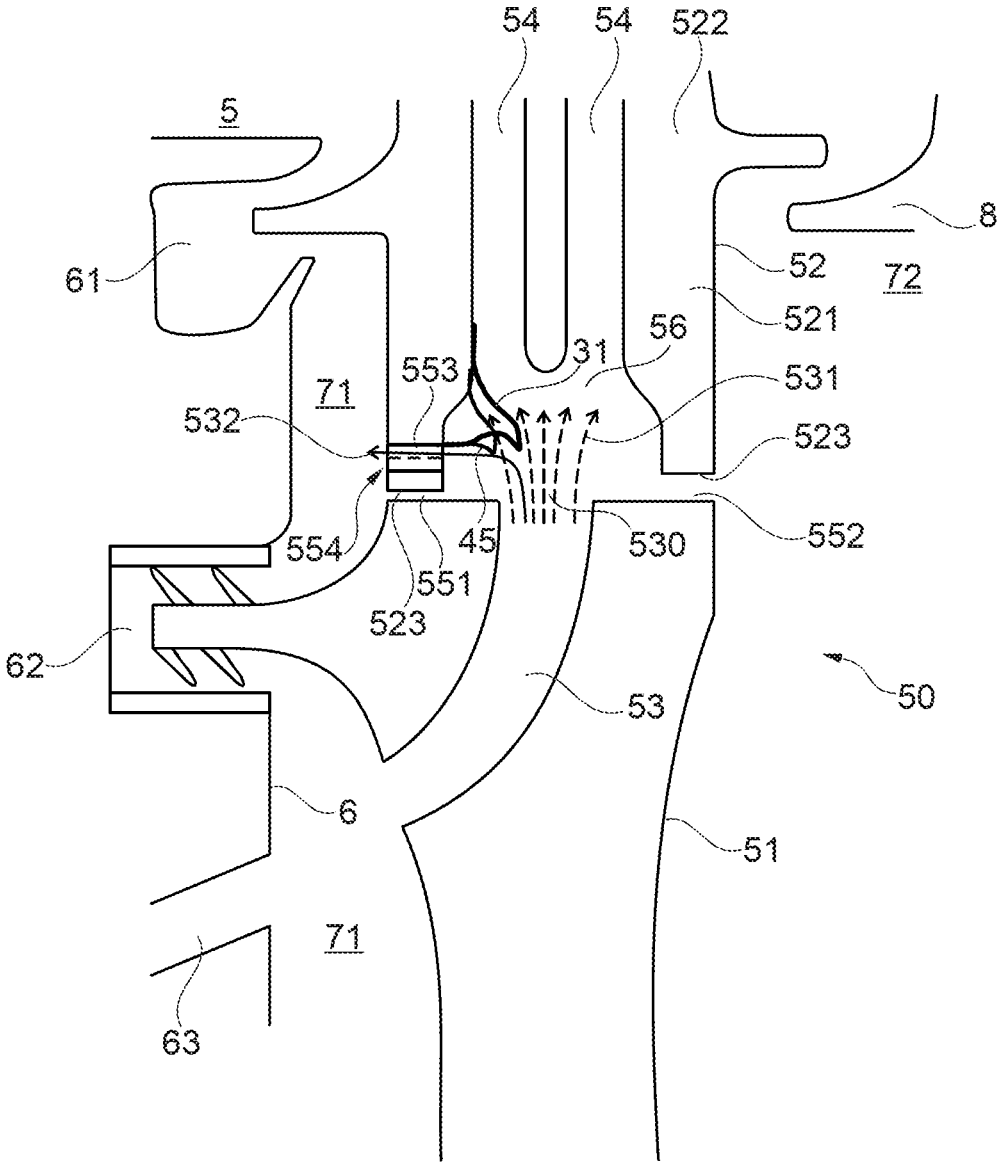
FIG. 4A shows a variation of the embodiment of FIG. 4, wherein the deflection device is formed by a concavely formed structural component that does not partially cover the discharge hole, which component, however, is hit by the air exiting the discharge hole.
Figure 4B:
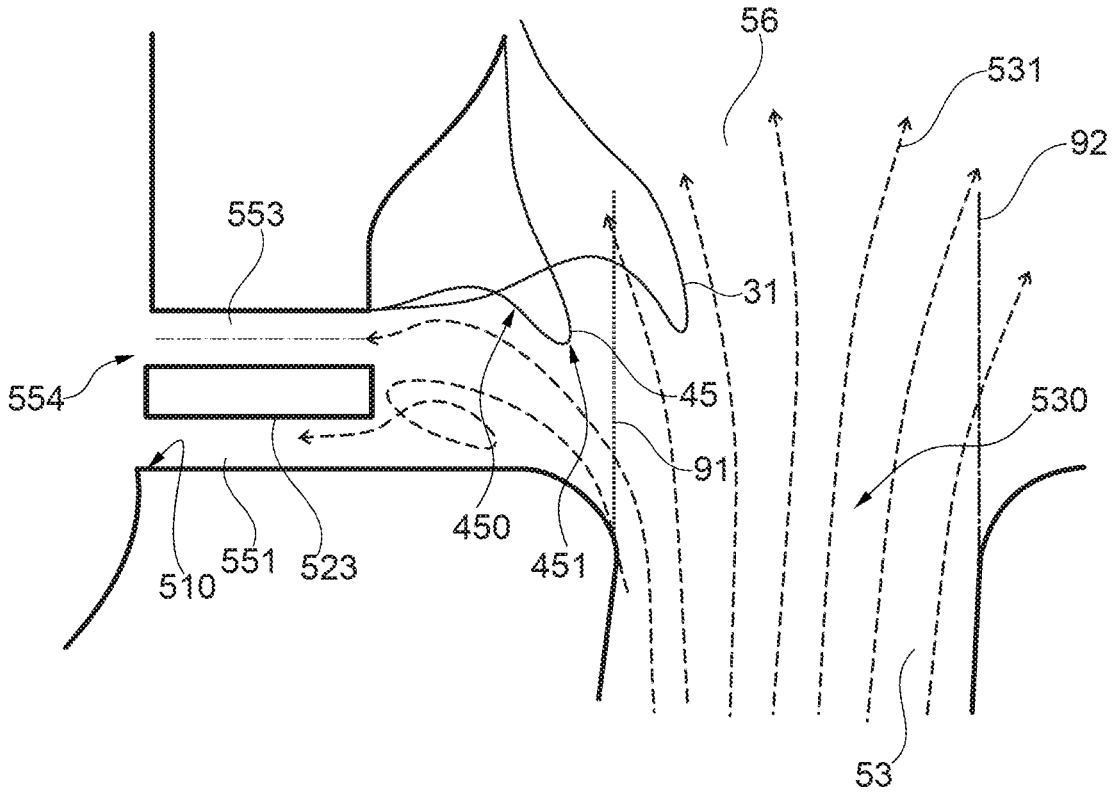
FIG. 4B in enlarged depiction of the area of the turbine rotor blade arrangement of FIG. 4A which forms the deflection device.

FIG. 4A shows a variation of the embodiment of FIG. 4. FIG. 4B shows the area of the deflection device of FIG. 4A in an enlarged manner. Similar as in FIG. 4, the air channel into which air is deflected by the deflection device is not formed by the gap 551 between the blade root and blade root reception area, but rather by an additional passage 553 which extends at a radial distance to the bottom side 523 of the blade root 521 and ends in a discharge hole 554.

The difference to the embodiment of FIG. 4 lies in the position of the deflection device. While in FIG. 4 the deflection device partly covers the discharge hole 530 of the disc channel 53, this is not the case in FIGS. 4A, 4B. Rather, a deflection device 45 is provided which does not cover the discharge hole 530, which, however, is it by the air exiting the disc channel in the divergent manner, which is schematically depicted by the flow paths of cooling air 531. In order to redirect the air exiting the disc channel 53 in a divergent manner with low losses, the surface 450 of the deflection device 44 which is facing the cooling air is formed in a concave manner. Thereby, such surface merges continuously into the radial outer wall of air channel 553. Similar as in FIG. 4, the deflection device 45 is located relatively deep inside the hollow space 56 of the blade root 521. The deeper the location inside hollow space 56, the more the deflection device 45 is hit by cooling air and able to redirect such cooling air into channel 553 even though there is no partial covering of the discharge hole 530 by the deflection device 45.

For a better comparison to the embodiment of FIG. 4, the deflection device 31 of FIG. 4 which partly covers the discharge hole 530 is also depicted in FIGS. 4A, 4B. In a view from above and counter to the radial direction, the deflection device 31 partly covers the discharge hole 530. In the sectional view of FIG. 4B the potential overlap area is schematically depicted by side limitations 91, 92. The nose 451 of the deflection device 45 which is closest to the discharge hole 530 is located outside such overlap area.

In the exemplary embodiments of FIGS. 3, 4, 4A and 4B, the deflection device 31, 45 is embodied as an integral structural component of the blade root 521. Thus, the deflection device 31, 45 is for example formed in one piece with further components of the rotor blade 52 by means of a casting or machining method.

Figure 5:
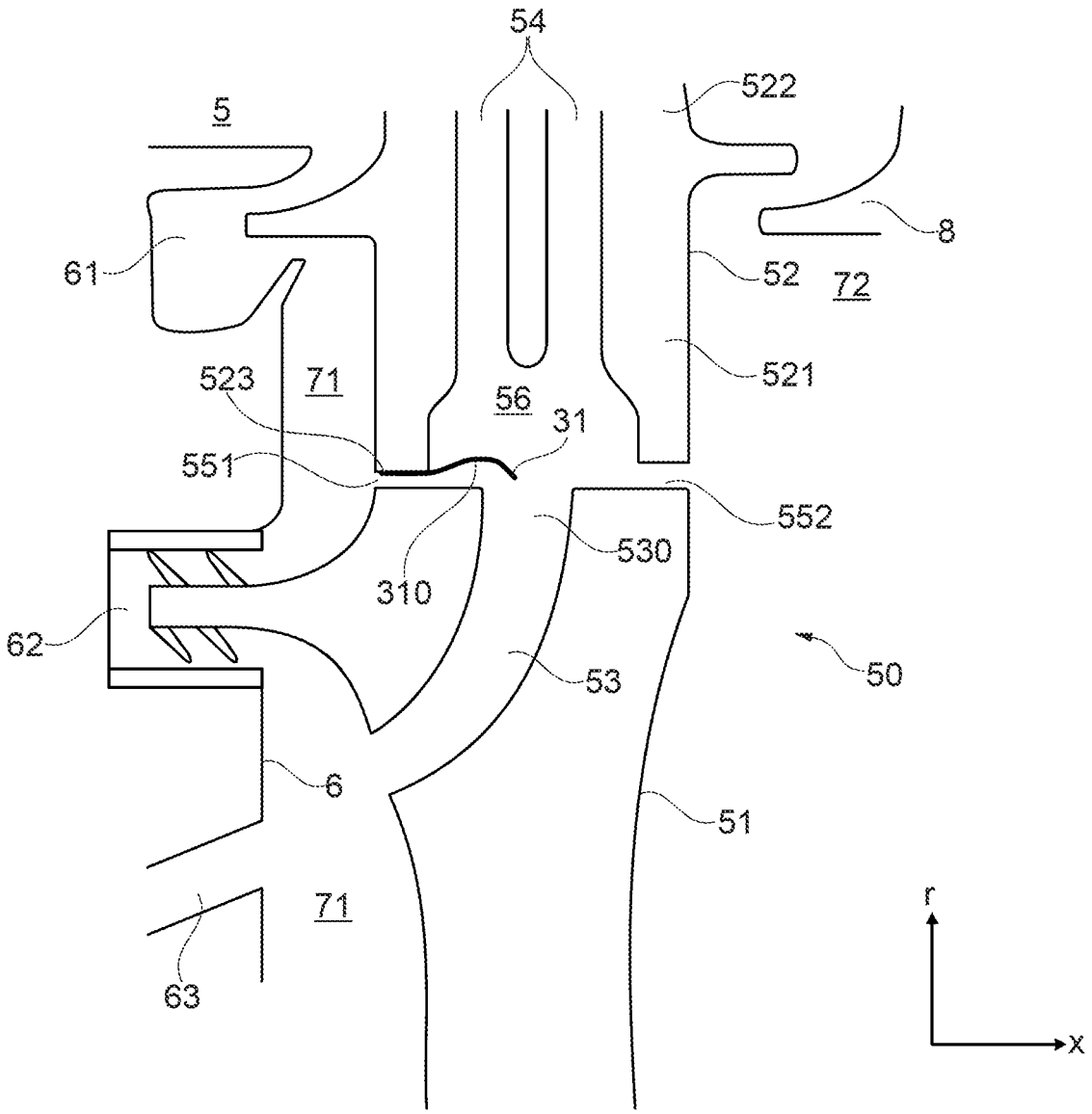
FIG. 5 shows an exemplary embodiment of a turbine rotor blade arrangement in which the deflection device is provided in the form of a curved plate that is attached at the bottom side of the blade root.

FIG. 5 shows an alternative exemplary embodiment of a turbine rotor blade arrangement 50, in which the deflection device 31 is formed by a curved metal sheet that has been subsequently attached at the bottom side of the blade root 521, for example by means of welding or hard soldering. Also in this exemplary embodiment, the deflection device 31 protrudes into the air flow that exits the disc channel 53 and deflects a portion of the air in the direction of an air channel 551, wherein in the exemplary embodiment of FIG. 5 the air channel 551 is formed by the gap between the blade root 521 and the blade root reception area, just as in the exemplary embodiment of FIG. 3. However, this is to be understood to be merely an example. On the bottom side 310 that is facing towards the disc channel 53, the deflection device 31 has a concave curvature. However, as will be described in the following, this is not necessarily the case, and in the most simple case the deflection device can be formed as a flat metal sheet that is attached at the bottom side 523 of the blade root 521.

It applies to all exemplary embodiments that towards their exit the air channels can be formed as nozzles.

Figure 6:
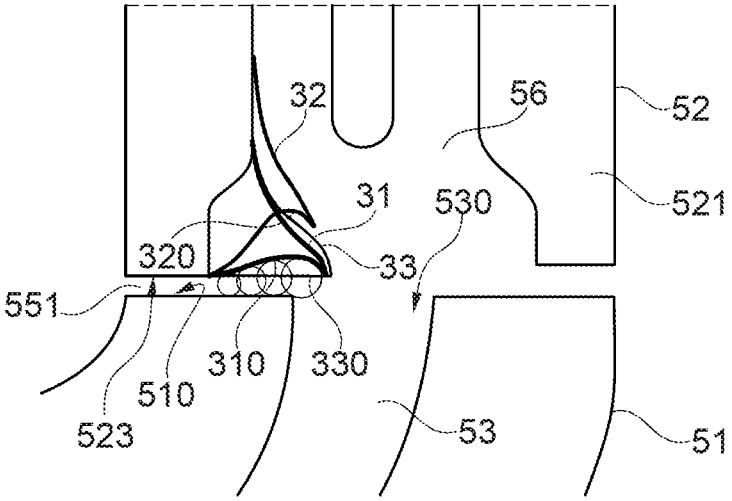
FIG. 6 shows an exemplary embodiment illustrating different geometries of a deflection device that is formed integrally with the blade root.

FIG. 6 shows three embodiment variants of the deflection device, in which the deflection device is formed integrally with the blade root 521 or the rotor blade 52. As is illustrated by the deflection devices 31, 32, 33, the radial distance, the degree of overlapping or coverage of the discharge hole 530, and the shape of the bottom side 310, 320 that is facing towards the discharge hole 530 may vary. As is illustrated by the deflection device 33, the bottom side 330 that is facing the discharge hole 530 can be formed in a flat manner and at that extend substantially perpendicularly to the flow direction of the cooling air exiting the discharge hole 530.

The deflection device 31 shows an approximately ideal geometry that is suitable for deflecting the cooling air into the cooling air passage 551 in a low-loss manner. Here, it forms a smoothly shaped boundary surface 310 that transitions continuously into the bottom side 523 of the blade root 521. Realized in the deflection device 32 is a geometry that is advantageous if a large axial clearance is present between the rotor blade 52 and the turbine disc 51. Since the deflection device 32 is arranged at a greater distance from the discharge hole 530 in the radial direction, and since the flow exiting the cooling air bore 53 is divergent, a sufficient portion of the cooling air can be deflected into the cooling air passage 551 even if the deflection device 32 covers the discharge hole 530 to a lesser extent, as shown in FIG. 6.

Further, it is to be understood that the width of the air channel 551 that is formed by the radial distance between the base wall 510 of the blade root reception area and the bottom side 523 of the blade root 521, converges in the direction of the leading edge of the blade root. In FIG. 6, the deflection device 31, 32, 33 is respectively formed at the bottom side 523 of the blade root 521.

Figure 7:
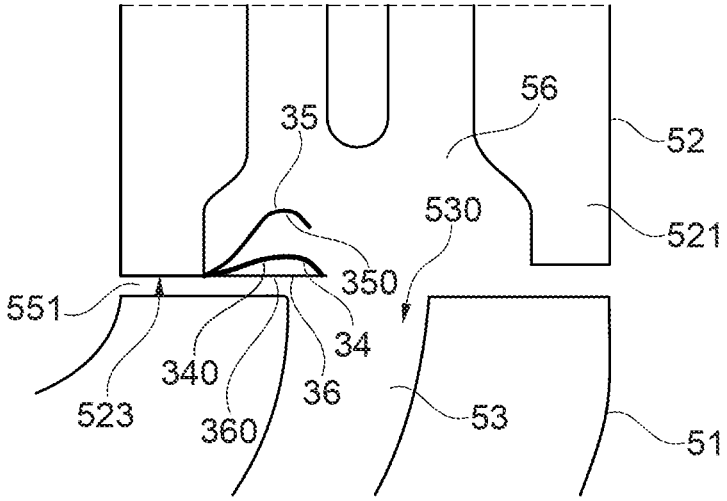
FIG. 7 shows an exemplary embodiment which illustrates, by way of example and in a schematic manner, different geometries of a separately manufactured deflection device that is connected to the blade root.

FIG. 7 shows three corresponding embodiment variants of a deflection device 34, 35, 36 that is formed as a separate part and is attached at the bottom side 523 of the blade root 521. Again, a flat bottom side 360 or differently shaped concave bottom sides 340, 350 can be realized. It is to be understood that the air channel 551 is formed by the deflection device 34, 35, 36 radially outside, adjoining the discharge hole 530 of the disc channel 53.

Figure 8:
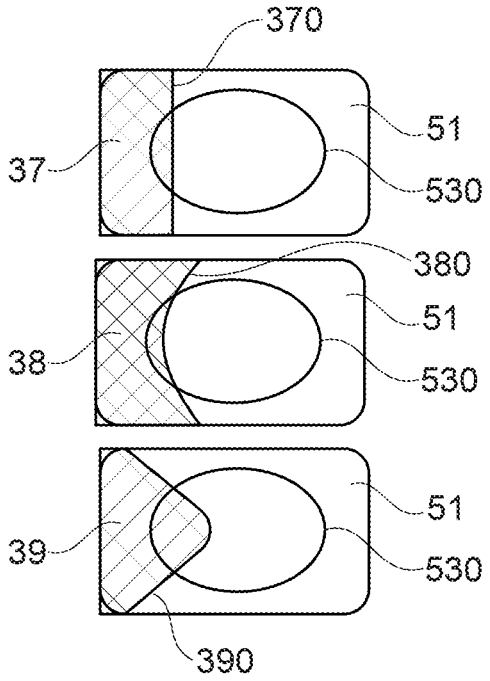
FIG. 8 shows, in a schematic manner, multiple embodiment variants for a partial coverage of the discharge hole of a disc channel by a deflection device.

FIG. 8 shows exemplary embodiments for the degree and the type of coverage of the discharge hole 530 of a disc channel by a deflection device. Here, the discharge hole 530 in the turbine disc 51 is respectively shown in a view from above. A deflection device 37, 38, 39 respectively partially covers the discharge hole 530. As shown in FIG. 8, the boundary line can have different shapes in the regarded view from above. In the top rendering, the boundary line 370 of the deflection device 37 is linear. In the middle rendering, the boundary line 380 of the deflection device 38 is concave with respect to the discharge hole 530. In the bottom rendering, the boundary line 390 of the deflection device 39 is convex with respect to the discharge hole 530.

The exact shape of the boundary line and the degree of covering the discharge hole 530 depends on the boundary conditions. On the one hand, it is to be ensured that the driving pressure ratio is sufficiently increased in the air channel for the intended functions. On the other hand, the cooling function of the rotor blades is not to be compromised.

Figure 9:
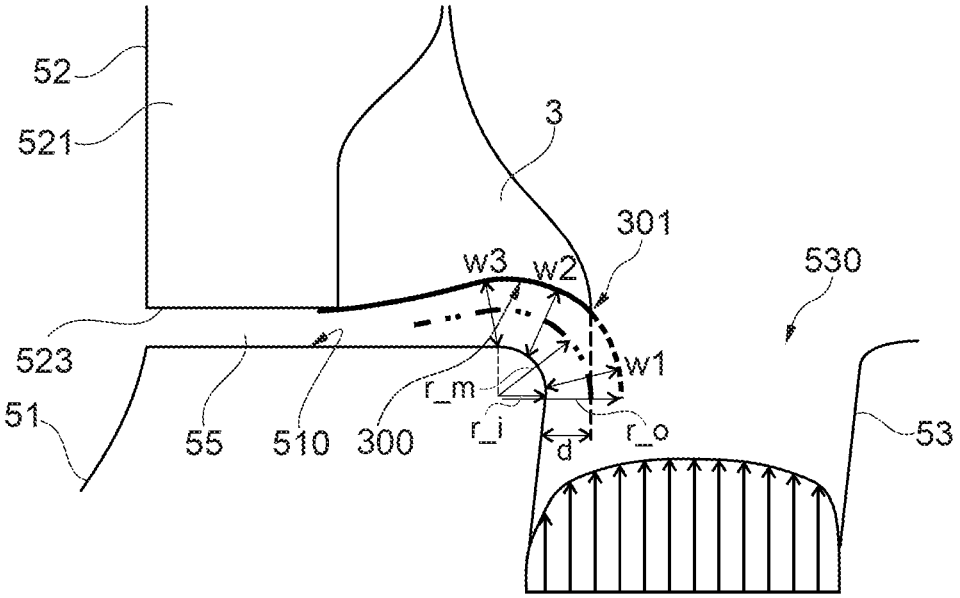
FIG. 9 shows a further exemplary embodiment of a turbine rotor blade arrangement, also showing certain geometric parameters.

As is explained with respect to FIGS. 6 and 7, the deflection device can have a flat surface in a simple embodiment. However, this is associated with the disadvantage of a rather low pressure increase. With the deflection device being formed by a concavely shaped structural component, considerably more dynamic pressure can be recovered, so that the driving pressure ratio increases more strongly. FIG. 9 shows exemplary parameters and parameter conditions that facilitate a small pressure loss. Here, a drag coefficient $k<0.2$ can be realized regarding the pressure losses at the deflection device.

The exemplary embodiment of FIG. 9 shows a deflection device 3 that, at its boundary line 301 that extends furthest beyond the discharge hole 530 of the disc channel 53, covers the discharge hole 530 by the length d. Here, the boundary line 301 can be configured corresponding to FIG. 8, for example. The length d significantly determines the portion of sealing air that is deflected in an air channel.

The air channel 55 has a radially outer boundary 523 that is formed by the bottom side 523 of the blade root 521 or the concavely shaped bottom side 300 of the deflection device 3. It further has a radially inner boundary 510 that is formed by the base wall of the blade root reception area of the turbine disc 51. At its end that is facing towards the disc channel 53, the radially outer boundary 523 is formed by the concave bottom side 300 of the deflection device 3. Here, it has a radius of curvature $r_o$. At its end that is facing towards the disc channel 53, the radially inner boundary of the air channel 55 has a radius of curvature $r_i$ with respect to the disc channel 53.

It has been found that low pressure losses occur at the deflection device 3 if the condition of $r_m/w>1$ is fulfilled, wherein w is the mean width of the air channel in the area of the deflection device 3 (averaged based on the values w1, w2, w3 of FIG. 9) and $r_m$ is the mean value of the two radiuses of curvature $r_o$ and $r_i$.

The present invention is not limited in its embodiment to the above-described exemplary embodiments, which are to be understood merely as examples. For example, it can alternatively be provided that cooling air is deflected by a deflection device in the direction of the trailing edge of the blade root. Likewise, the shown proportions and surface shapes of the deflection device are to be understood merely as examples.

It should be understood that the above description is intended for illustrative purposes only, and is not intended to limit the scope of the present disclosure in any way. Thus, those skilled in the art will appreciate that other aspects of the disclosure can be obtained from a study of the drawings, the disclosure and the appended claims. All methods described herein can be performed in any suitable order unless otherwise indicated herein or otherwise clearly contradicted by context. Various features of the various embodiments disclosed herein can be combined in different combinations to create new embodiments within the scope of the present disclosure. Any ranges given herein include any and all specific values within the range and any and all subranges within the given range.

What is claimed is:

1. A turbine rotor blade arrangement for a gas turbine, comprising:

a turbine disc including a plurality of blade root reception areas arranged around a circumference of the turbine disc;

a turbine rotor blade ring including a plurality of rotor blades, wherein a rotor blade of the plurality of rotor blades includes a blade root, and wherein the blade root is arranged inside a blade root reception area of the plurality of blade root reception areas;

a disc channel including a discharge hole, wherein the disc channel is arranged in the turbine disc to provide a cooling air, and wherein the disc channel ends at the discharge hole in an area of the blade root reception area;

a cooling air channel arranged for cooling the rotor blade, wherein the cooling air is supplied from the disc channel to the cooling air channel;

a deflected air channel formed in at least one chosen from the blade root and an area between the blade root and the blade root reception area; and a projection positioned at the blade root, wherein the projection is configured to partially deflect the cooling air discharged from the disc channel toward the deflected air channel, and wherein the projection forms a concave surface that extends concavely with respect to the disc channel.

2. The turbine rotor blade arrangement according to claim 1, wherein the projection is arranged and configured in such a manner that the cooling air is deflected into the deflected air channel in a direction of a leading edge of the blade root.

3. The turbine rotor blade arrangement according to claim 1, wherein the projection is arranged and configured in such a manner that the cooling air is deflected into the deflected air channel in a direction of a trailing edge of the blade root.

4. The turbine rotor blade arrangement according to claim 1, wherein the projection forms an initial area of the deflected air channel.

5. The turbine rotor blade arrangement according to claim 1, wherein the projection forms a flat surface at which the cooling air discharged from the disc channel is partially deflected.

6. The turbine rotor blade arrangement according to claim 1, wherein the concave surface transitions smoothly into the deflected air channel.

7. The turbine rotor blade arrangement according to claim 1, wherein the deflected air channel further comprises:

a radially outer boundary and a radially inner boundary with respect to an end of the disc channel in an area of the discharge hole that faces toward the deflected air channel, wherein the radially outer boundary is formed by the concave surface and faces towards the disc channel, and wherein the radially outer boundary and radially inner boundary define a width of the deflected air channel therebetween;

an inner radius of curvature of the radially inner boundary with respect to the end of the disc channel and an outer radius of curvature of the radially outer boundary with respect to the end of the disc channel;

a centerline radius of curvature located on a centerline between the inner radius of curvature and the outer radius of curvature, wherein the centerline radius of curvature is greater than an average width of the deflected air channel.

8. The turbine rotor blade arrangement according to claim 1, wherein the projection is formed by a nose-shaped structural component.

9. The turbine rotor blade arrangement according to claim 1, wherein the projection partially covers the discharge hole of the disc channel.

10. The turbine rotor blade arrangement according to claim 9, wherein, in a view from above onto the discharge hole, the projection partially covers the discharge hole along a straight boundary line.

11. The turbine rotor blade arrangement according to claim 9, wherein, in a view from above onto the discharge hole, the projection partially covers the discharge hole along a boundary line that is concave with respect to the discharge hole.

12. The turbine rotor blade arrangement according to claim 9, wherein, in a view from above onto the discharge hole, the projection partially covers the discharge hole along a boundary line that is convex with respect to the discharge hole.

13. The turbine rotor blade arrangement according to claim 9, wherein in a view from above onto the discharge hole, the projection partially covers at least 10% of a total cross-sectional surface of the discharge hole.

14. The turbine rotor blade arrangement according to claim 1, wherein the deflected air channel is formed by a gap extending in an axial direction with respect to the turbine disc, wherein the gap extends between the blade root reception area and the blade root, and wherein the projection is arranged at a bottom side of the blade root.

15. The turbine rotor blade arrangement according to claim 1, wherein the deflected air channel is formed by a passage extending from a blade root hollow space to an opening in the blade root that is formed at one chosen from a leading edge and a trailing edge of the blade root, wherein the projection is formed in the blade root hollow space.

16. The turbine rotor blade arrangement according to claim 1, wherein an end section of the deflected air channel is oriented at an angle to an axial direction of the gas turbine.

17. The turbine rotor blade arrangement according to claim 1, wherein the projection is an integral component of the blade root.

18. The turbine rotor blade arrangement according to claim 1, wherein the projection is a separately manufactured structural component connected to a bottom side of the blade root.

19. A method for the provision of sealing air in a turbine rotor blade arrangement comprising:

providing:

a turbine disc including a plurality of blade root reception areas arranged around a circumference of the turbine disc;

a turbine rotor blade ring including a plurality of rotor blades, wherein a rotor blade of the plurality of rotor blades includes a blade root, and wherein the blade root is arranged inside a blade root reception area of the plurality of blade root reception areas;

a disc channel including a discharge hole, wherein the disc channel is arranged in the turbine disc to provide a cooling air, and wherein the disc channel ends at the discharge hole in an area of the blade root reception area;

a cooling air channel arranged for cooling the rotor blade, wherein a cooling air is supplied from the disc channel to the cooling air channel;

a deflected air channel formed in at least one chosen from the blade root and an area between the blade root and the blade root reception area; and a projection positioned at the blade root configured to partially deflect the cooling air discharged from the disc channel toward the deflected air channel, and wherein the projection forms a concave surface that extends concavely with respect to the disc channel; and discharging the cooling air from the disc channel; and partially deflecting the cooling air via the projection into the deflected air channel and away from the blade root.

20. The method according to claim 19, wherein the cooling air exiting the deflected air channel is guided to a seal that is formed in an edge area of a main flow channel of the gas turbine between the turbine rotor blade arrangement and an adjoining non-rotating structure.

* * * * *